US008789624B2

(12) United States Patent
Taghipour Khadrbeik

(10) Patent No.: US 8,789,624 B2
(45) Date of Patent: Jul. 29, 2014

(54) CUTTING TOOL INTEGRATED IN A DRILLSTRING

(75) Inventor: Mohammad Ali Taghipour Khadrbeik, Trondheim (NO)

(73) Assignee: Sinvent AS, Trondheim (NO)

( * ) Notice: Subject to any disclaimer, the term of this patent is extended or adjusted under 35 U.S.C. 154(b) by 0 days.

(21) Appl. No.: 13/805,116

(22) PCT Filed: Aug. 12, 2011

(86) PCT No.: PCT/NO2011/000223
§ 371 (c)(1),
(2), (4) Date: Dec. 18, 2012

(87) PCT Pub. No.: WO2012/021069
PCT Pub. Date: Feb. 16, 2012

(65) Prior Publication Data

US 2013/0092444 A1 Apr. 18, 2013

(30) Foreign Application Priority Data

Aug. 12, 2010 (NO) ..... 20101143

(51) Int. Cl.
*E21B 10/30* (2006.01)

(52) U.S. Cl.
USPC ..... 175/346; 175/345; 175/347

(58) Field of Classification Search
USPC ..... 175/346, 345, 347
See application file for complete search history.

(56) References Cited

U.S. PATENT DOCUMENTS 1,796,546 A * 3/1931 Campbell et al. ..... 175/286
1,812,044 A * 6/1931 Grant ..... 175/288
1,819,367 A * 8/1931 Grant ..... 175/283
1,885,550 A * 11/1932 Santiago ..... 175/274
2,069,796 A * 2/1937 Zublin ..... 175/346
2,122,763 A 7/1938 Smith, Jr.
2,172,762 A 9/1939 Koppl
2,189,033 A 2/1940 Book et al.
2,189,037 A 2/1940 Harrington
2,199,693 A 5/1940 Catland
2,260,366 A 10/1941 Childs
2,306,492 A 12/1942 Noble
2,719,700 A * 10/1955 Kammerer ..... 175/271

(Continued)

FOREIGN PATENT DOCUMENTS

GB 1 208 127 10/1970
WO 02/064939 8/2002

OTHER PUBLICATIONS

International Search Report issued Jan. 20, 2012 in corresponding International Application No. PCT/NO2011/000223.

(Continued)

*Primary Examiner* — Nicole Coy

(74) *Attorney, Agent, or Firm* — Wenderoth, Lind & Ponack, L.L.P.

(57) ABSTRACT

The present invention discloses a cutting tool integrated in a drillstring for enlarging a borehole, where the cutting tool at least comprises: one or more side mills (12, 13, 14) arranged along the axis of said drillstring in a reamer housing (11), where the side mills (12, 13,14) are adapted to be rotated relative to the tool housing (11) by individual driving means. The self driven rotational side mills may be dome shaped cones where expand radially out of the reamer housing (11), or may be a special non-circular dome shaped cones where rotates without expanding.

15 Claims, 5 Drawing Sheets

(56) References Cited

U.S. PATENT DOCUMENTS

| | | | | |
|---|---|---|---|---|
| 3,306,381 | A | 2/1967 | Garrett et al. | |
| 3,627,068 | A | 12/1971 | Wagnon et al. | |
| 3,907,048 | A | 9/1975 | Gray | |
| 3,917,011 | A | 11/1975 | Hester | |
| 4,000,783 | A * | 1/1977 | Hug | 175/346 |
| 4,036,314 | A | 7/1977 | Dixon et al. | |
| 4,102,416 | A * | 7/1978 | Hug | 175/227 |
| 4,182,425 | A | 1/1980 | Garrett | |
| 4,398,610 | A | 8/1983 | Bassinger | |
| 4,431,065 | A | 2/1984 | Andrews | |
| 4,589,504 | A | 5/1986 | Simpson | |
| 5,060,738 | A | 10/1991 | Pittard et al. | |
| 5,368,114 | A | 11/1994 | Tandberg et al. | |
| 2,698,738 | A | 1/1995 | Turner | |
| 5,678,644 | A | 10/1997 | Fielder | |
| 5,992,548 | A | 11/1999 | Silva et al. | |
| 6,082,470 | A | 7/2000 | Webb et al. | |
| 6,340,064 | B2 | 1/2002 | Fielder et al. | |
| 6,378,632 | B1 | 4/2002 | Dewey et al. | |
| 6,394,200 | B1 | 5/2002 | Watson et al. | |
| 7,090,034 | B2 * | 8/2006 | Rives | 175/53 |
| 8,347,989 | B2 * | 1/2013 | Buske et al. | 175/335 |
| 2004/0134687 | A1 | 7/2004 | Radford et al. | |
| 2006/0237234 | A1 | 10/2006 | Dennis et al. | |
| 2009/0194335 | A1 | 8/2009 | Kennedy et al. | |
| 2009/0294173 | A1 | 12/2009 | Laird et al. | |

OTHER PUBLICATIONS

International Preliminary Report on Patentability issued Oct. 5, 2012 in corresponding International Application No. PCT/NO2011/000223.

Norwegian Search Report issued Mar. 11, 2011 in corresponding Norwegian Application No. 20101143.

"Chapter II-Demand" dated Aug. 14, 2012 in corresponding International Application No. PCT/NO2011/000223.

* cited by examiner

CUTTING TOOL INTEGRATED IN A DRILLSTRING

TECHNICAL FIELD

The invention relates to cutting tools which can be used in drilling oil, gas and deep water wells and mining operations. In particular it relates to a cutting tool integrated in a drillstring.

BACKGROUND ART

Drill bits used to drill wellbores through earth formations typically have a nominal diameter, that is, the diameter that will be created when the drillbit is rotated and impressed axially onto the formation. Frequently it is desirable to enlarge the diameter of the borehole beyond the nominal diameter of the drillbit for several purposes. It is well known that in the process of drilling a deep well for oil and gas production; under reaming of a borehole, it is necessary to treat the borehole wall so as to prevent reduced predetermined diameter of the borehole and also to enlarge the diameter of the borehole drilled by the main bit in front of the drillstring.

Numerous attempts have been made to provide proper tools for enlarging a borehole particularly in the oil wells. One of the known prior art attempts is to use specialized drill bits, known as bi-centre bits. Bi-centre bits have been developed to create boreholes with drilled diameter greater than the diameter of the opening through which such bits will pass when they are not rotated. U.S. Pat. Nos. 6,340,064; 6,394,200; 5,992,548; 5,678,644 are examples. Rather than employing a one-piece drilling structure, such as an eccentric bit or a bi-centre bit to enlarge a borehole, it is known that reamers including reamer wings typically are assembled to a drillstring at an axial position behind the drillbit. Underreamers have basically two operating states, a closed or collapsed state which enables them to pass through the narrowest section of the borehole and an open or partly expanded state where one or more arms with cutters extend radially outward from the rotational centre of the tool body. When the reamer rotates, the cutting elements on the extended arms enlarge the boreholes. U.S. Pat. Nos. 4,589,504; 5,368,114; 5,060,738; 4,431,065 are examples of hole-openers with solid expandable arms.

It is also known in the prior art that roller side cutters are used instead of the solid cutter blades to ream and enlarge a borehole. Examples of roller side cutters are found in the patent documents U.S. Pat. Nos. 2,122,763; 2,172,762; 2,189,033; 2,189,037; 2,199,693; 2,260,366; 2,306,492; 3,306,381; 3,627,068; 3,907,048; 4,182,425; 4,398,610; 4,036,314. U.S. Pat. Nos. 6,378,632; and 3,917,011 are special cases using rotary roller cones to increase the borehole diameter.

Moreover it is known from US 2004/0134687 A1 to use an expandable reamer apparatus and methods for reaming a borehole, wherein a laterally movable blade carried by a tubular body may be selectively positioned at an inward position and an expanded position. The movable blade, held inwardly by blade-biasing elements, may be forced outwardly by drilling fluid selectively allowed to communicate therewith by way of an actuation sleeve disposed within the tubular body.

The publication U.S. Pat. No. 6,378,632 B1 discloses an underreamer that opens a borehole below a restriction that is larger than the restriction itself. The underreamer includes cutters which engage the formation by traversing outward and upward. The force pushing the cutters to the extended position is supplied by a piston built into each cutter support. Pressure acting on these pistons comes from the pressure differential between the annulus and drill string during circulation of drilling fluid.

GB 1208127 relates to well reamers and more particularly to well reamers having a single-roller-cutter used for enlarging well bores.

Other examples of reamers can be found in WO 02/064939 A1, U.S. Pat. No. 6,378,632 B1 and US 2009/0294173 A1.

Enlarging the borehole diameter with cutting blades or with passive rollers is associated with increased drillstring torque. In addition, due to operational limitation such as vibration, the enlarged diameter is limited when using passive cutters. Use of the active rotary cutters is favourable with respect to the torque and will also enable to drill larger borehole than what is possible today.

According to the present invention it is an object to provide a tool which overcomes the drawbacks of increased drillstring torque and vibration which occur when using prior art devices.

DISCLOSURE OF INVENTION

In the present invention, a new reamer with special side cutters with self rotating ability is presented. Employing self driven rotational side cutters instead of passive blade and roller cutters for enlarging the borehole is a focused area according to the present invention. Use of the active rotary cutters is favourable with respect to the torque and will also enable to drill larger borehole than what is possible today.

In particular the object of the invention is met by a cutting tool integrated in a drillstring where the cutting tool at least comprises one or more side cutters arranged along the longitudinal axis of said drillstring in a reamer housing, where the side cutters are adapted to be rotated independent of the reamer housing around an axis that that is not parallel with the axis of rotation of said drillstring.

According to one embodiment of the invention the cutting tool is specified in that the side cutters are adapted to be rotated by individual driving means.

According to one embodiment of the invention the cutting tool is specified in that the dome shaped self driven rotational side cutters extends radially outward from the body of the reamer by means of an actuating system. The rotational side cutters extends radially outward from the body of the reamer relative to the tool housing to a greater extent than the borehole diameter and thereby dig into the borehole sidewalls and remove the material in a milling process. The housing may include at least one actuator for actuating the at least one mill between an extended operating position and a retracted position, in particular to be able to retract the mill or mills during running in or retrieval of the drillstring. The actuating mechanism may according to one aspect of this embodiment comprise one of drilling mud pressure or mechanical means.

In another embodiment the cutting tool is specified in that the dome shaped self driven rotational side cutters have a non circular cross section. These non circular side cutters according to one aspect of this embodiment can be rotated without extending radially outward from the housing body where they don't protrude out of the reamer housing in the passive state, and in rotating state the non circular cone, will limp and protrude out of the reamer housing to a greater extent than the borehole diameter and thereby dig into the borehole sidewalls. The crank shaped rotational side cones can have any non circular cross section with aspect ratios larger than one (1.00), where an aspect ratio is defined as the ratio of a length to a width of the cross section shape. So, for example, as defined herein, a circle has an aspect ratio of one, and an ellipse has an aspect ratio greater than one since its major axis (length) is larger then its minor axis (width).

According to this embodiment the apparatus may include different sizes of crank shaped rotational side cones with non-circular cross section to enlarge a borehole stepwise, where the smallest side cutter is arranged closest to the drillbit and provide the first stage of the enlargement.

In both embodiments, by simultaneous rotation of the tool housing and the side cutters the bore hole can be enlarged to a greater diameter than the original. In addition, both embodiments according to the present invention provide a cutting tool where the driving means can be any of: a mud motor, a hydro motor, a hydraulic motor or an electric motor. Further, a gear transmission system may be arranged to transfer rotational motion from the driving means to the side cutters. The individual driving means can be one of: a hydro motor or an electric motor with direct drive of the side cutters. The invention focus on using active self driven rotational side cutters to enlarge the borehole while in the traditional reamers, passive wings/blades/rollers are used.

Other features and advantages according to the present invention will be apparent from the dependent claims.

BRIEF DESCRIPTION OF DRAWINGS

To make the invention readily understandable it will now be described with reference to the drawings in which.

DETAILED DESCRIPTION OF THE INVENTION

Figure 1:
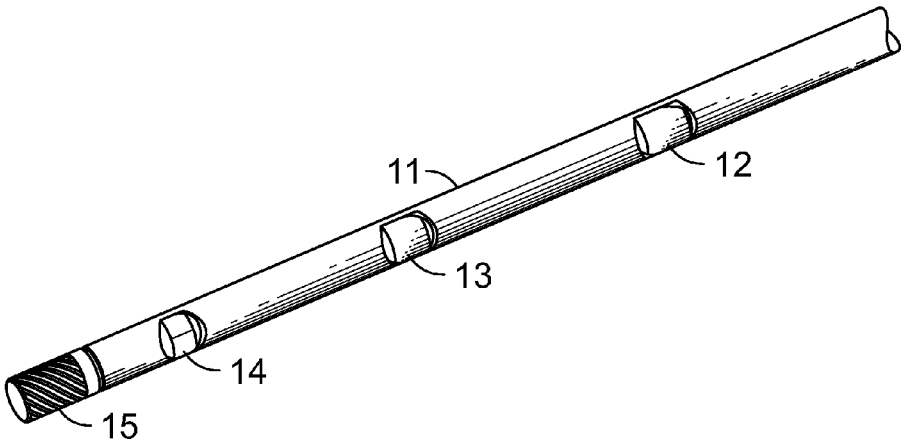
FIG. 1 shows a schematic view of the reamer with three active rotational side cutters placed in one direction.

The invention will now be described with support from the drawings in which identical reference numbers indicates similar features. The drawings are included for illustrative purposes so as to make the principle of the invention readily understandable; it shall be appreciated that the person skilled in the art will realize other embodiments than those illustrated by the drawings.

In the following the following definition applies; cutters shall be understood as any cutting tools arranged along the drillstring/reamer behind a drill bit with the purpose of drilling bore hole walls. Also, side cutters and cones are used interchangeably and shall be included in the definition of cutters.

The basic idea behind the invention is to provide reamers which include one or more cutters arranged behind a drillbit, where at least one of the cutters are rotated by a means different than that of the drillbit.

Firstly a general embodiment utilizing self powered cutters will be described; thereafter exemplary embodiments will be disclosed.

The new borehole reamer according to the present invention has a cylindrical housing, placed as a part of the drillstring. It includes at least one rotational cone on the side of the drillstring, almost vertical to the axis of the borehole. The side cones can be rotated by using hydraulic driven/mud motor system placed inside the main housing. However many other means of driving systems can be utilized, it is the individualization of powering the cones/cutters that is important in this context. An internal hydraulic driving system can be placed either, axial to the side cones or axial to the direction of drillstring and to rotate the side cones by using a gear/transmission system or by direct drive. Also the driving means can be electric motors with gear transmission drive or by direct drive.

According to the present invention two alternative designs of the rotational side cutters are disclosed.

- In the first design, the rotational side cones will extend radially outward relative to the tool housing to a greater extent than the borehole diameter. The radial extension of the side cones may be provided by drilling mud pressure or by use of other mechanical systems, including electrical powered systems.
- In the second alternative the side cones have special non-centric design. The cones with non-circular cross section will be rotated without extending out of body of the reamer by mechanical, hydraulic and even electric mechanisms, ref FIGS. 2, 4 and 5.

In both alternatives, the cutting elements mounted on the side cones will rotate around the axis of the cone while the axis of the cone itself will rotate with the drillstring rotation. Use of this concept leads to create new cutting path of the cutting elements which will reduce the drillstring torque. In addition, employing this concept will enable use of the hydraulic energy of the circulating mud for the borehole enlargement process for higher drilling efficiency. By implementing several side cones with different sizes in one tool, it will be possible to achieve a larger borehole compared with the traditional reamers.

FIG. 1 shows a schematic view of a reamer assembly 11 in accordance with one embodiment of the invention. The reamer 11 has three side cones/cutters 12, 13, 14 placed on the side of the reamer housing 11. The cones/cutters 12, 13, 14 are shown in openings of the reamer housing 11, whereas the drillbit 15 which is in front of the drillstring will rotate with the main reamer housing. The side cones/cutters 12, 13, 14 can rotate around their axis vertical to the drillstring axis. For better understanding of the tool the side cutters are shown at one side of the reamer body 11 but they may be placed with a mutual angle between each other, consideration of vibration shall however be taken into account when the side cones/cutters 12, 13, 14 are arranged. In this example where three cones are used, the cones may be arranged at three different sides of the tool body with each 120° spacing. The tool can as indicated also be designed with different number of rotational side cutters depending on particular applications.

Figure 2:
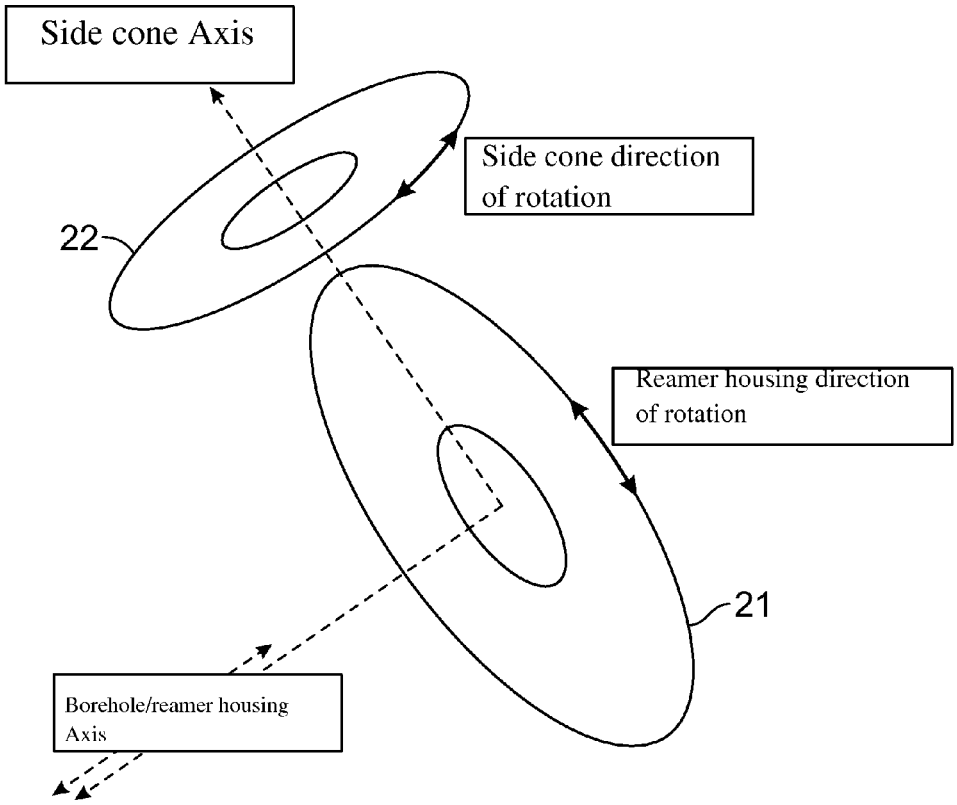
FIG. 2 shows direction and axis of the rotations in the reamer with rotational side cones.

The direction and axis of the rotations is explained in FIG. 2, in which a circle 22 perpendicular to the drillstring circle 21 shows the cutting path of a cutter element while rotating around the side cone axis. Rotation of the reamer housing is shown by the circle 21 and the arrow indicates the borehole axis.

Figure 3:
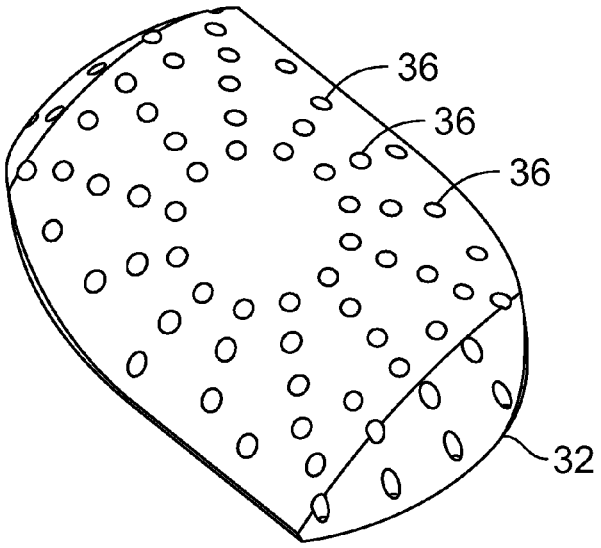
FIG. 3 shows a schematic view of a side cone with non-circular cross section covered by the cutting elements.

Schematic of a typical non centric side cutter 32 is shown in FIG. 3. As shown in the figure the side cone 32 according to this alternative design has non centric shape covered with cutting elements 36.

Figure 4:
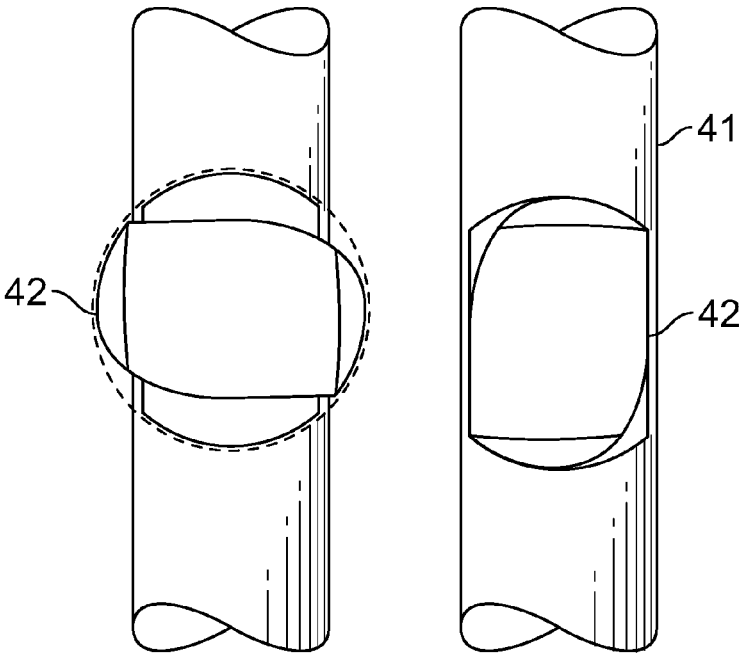
FIG. 4 shows a schematic view of a side cone while rotating (left) and in non activated position (right)

FIG. 4 indicates a view of a non centric cone 42 when it starts to rotate on the left, the cutting elements in the non centric part of the cone will cover a larger diameter than the reamer housing 41. The reamer housing 41 will be a part of the rotary drillstring and therefore will rotate around the axis of the borehole. In operational conditions, the side cones will rotate while the reamer housing 41 is also rotating and therefore the side cones will cover a larger area than the reamer housing and enlarge the borehole. The right side of the FIG. 4 indicates a cone in a passive state, it can readily be seen that the cone 42 does not extend beyond the perimeter of the reamer 41 itself in this state.

Figure 5:
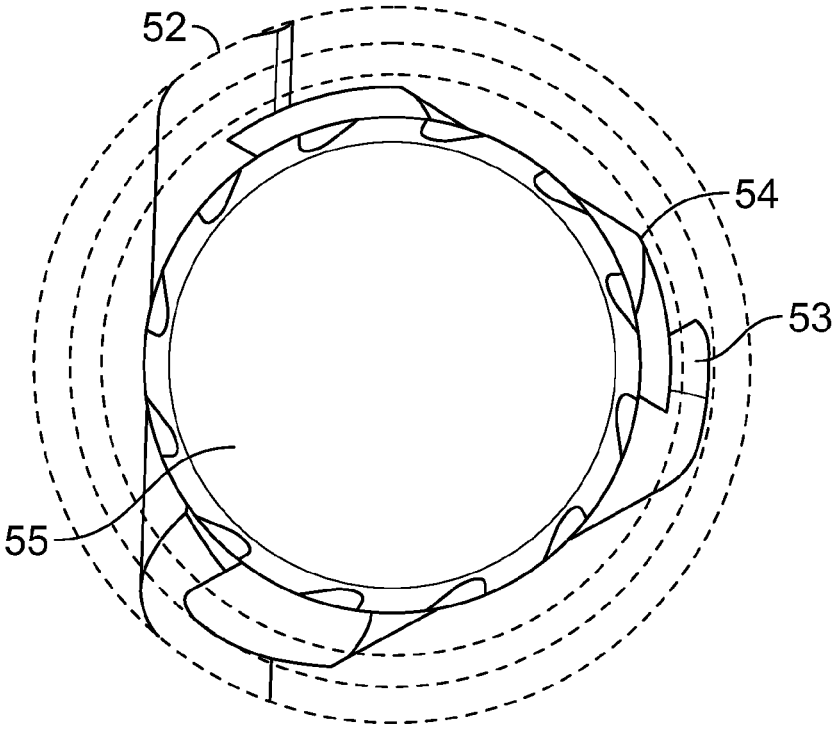
FIG. 5 shows cutting area of a reamer with three active rotational side cutters.

FIG. 5 shows examples of cutting areas of a three active cones reamer in accordance with the invention. The cones 52, 53, 54 are placed at different sides of the housing (120° spacing) and the smallest cone 54 is placed near the drillbit 55. Cutting path of the cones is shown by appropriate circles. Consequently, the borehole will be enlarged in three steps while the main borehole has been made by the drillbit 55. However it shall be appreciated that in principle any number of cutters can be arranged in the housing of the reamer, the smallest will be arranged closest to the drillbit 55, whereas the largest will be arranged at the most remote position relative to the drill bit 55.

Figure 6:
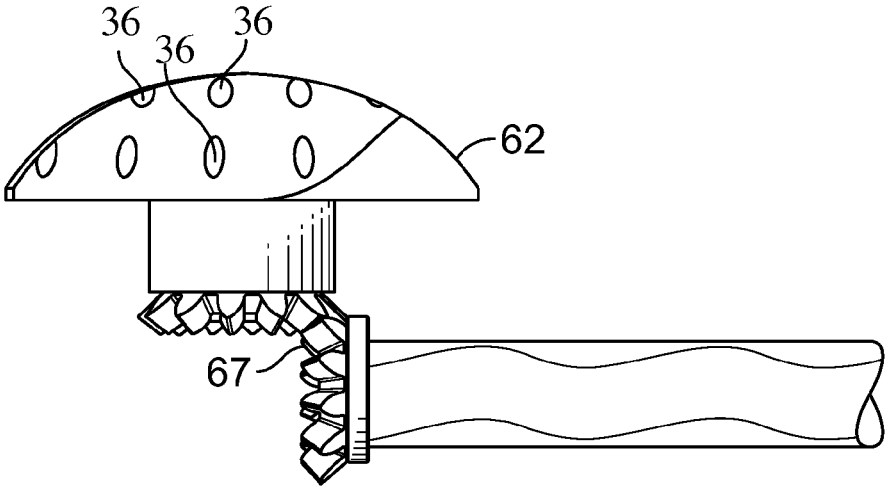
FIG. 6 shows a schematics view of one driving system according to one aspect of the invention using hydraulic mud motor and bevel gears.
Figure 7:
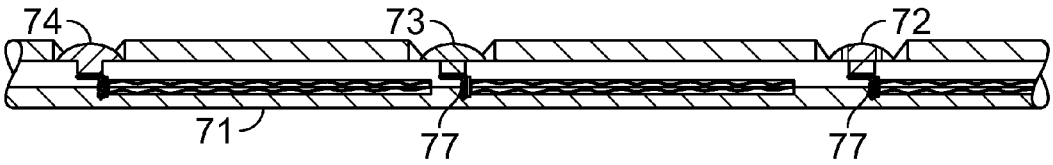
FIG. 7 shows a cross sectional view of individual driving systems for each three cones.

Side cones can be rotated by internal mud motors and thereby use the hydraulic energy of circulating mud. However, drillstring mechanical energy or electric motors can also be used for driving the side cones. FIGS. 6 and 7 shows examples of use of internal mud motor(s) including a proper gear transmission system 67, 77 for driving the side cones 62, 72, 73, 74. Any suitable gear type can be utilized. Different gear types such as worm or bevel can be used depending on the tool design. In addition, high torque hydro-motors can also be employed without gear system, the same applies to electric motors.

Each side cone has individual driving system and can be rotated independent of the other side cones. FIG. 7 shows schematics of a reamer cross section 71 with individual driving system 78.

In the particular presented apparatus, the smallest side cutter must be derived first to enlarge the borehole needed to start rotation of the medium cutter. Consequently, the biggest side cutter must be rotated at the final stage where the borehole has been enlarged by the medium cutter. When the three side cones, according to this exemplary embodiment, rotate while the drillstring rotates, the borehole will be fully enlarged. Proper centralizer mechanism may be employed in the entire body of the reamer to centre the tool in the borehole.

Figure 8:
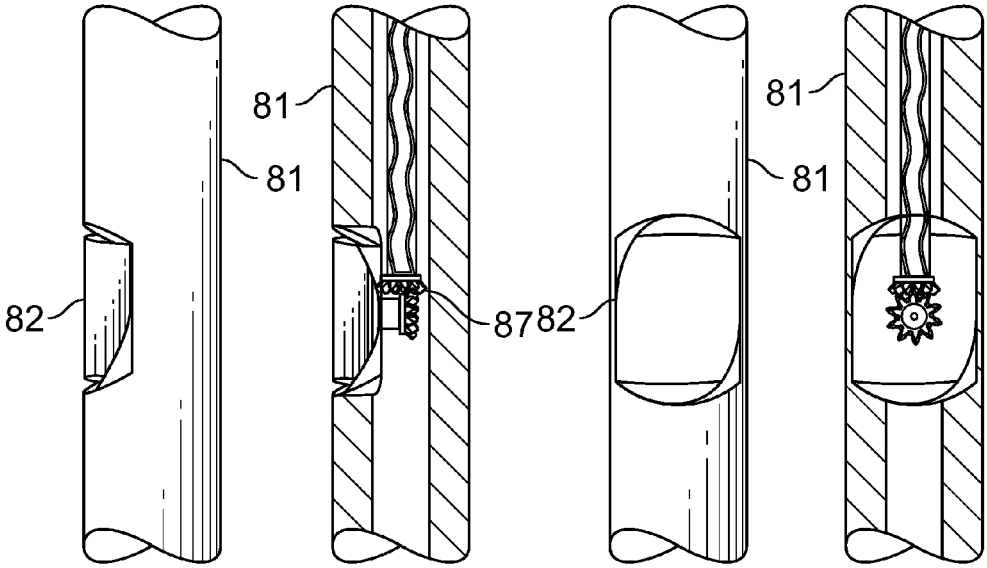
FIG. 8 shows a schematic view of the rotary side cone stopped at neutral position

When tripping the tool in and out of the borehole, especially in the casing section or where the enlarged borehole is not needed, side cutters will stop rotating and be placed in the initial neutral positions as shown in FIG. 8, hence the side cutters 82 will be hided by the body of the reamer 81.

Figure 9:
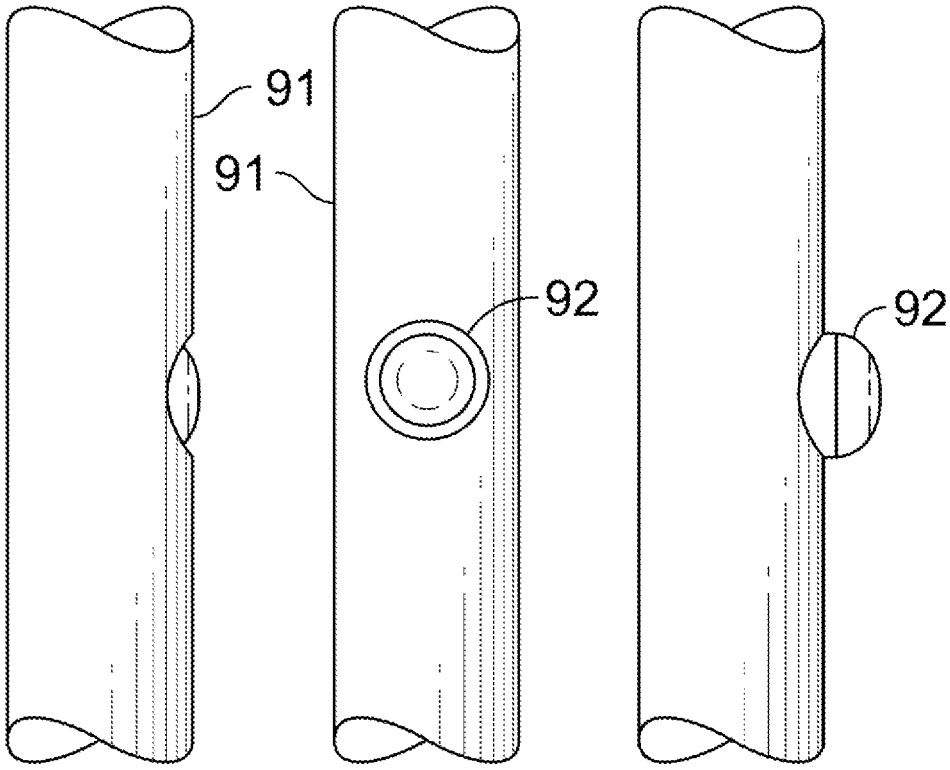
FIG. 9 shows a schematic view of a reamer housing with rotary expandable side cutter (middle) in non-active position (left) and radial expanded position (right)

FIG. 9 shows schematic view of a reamer in accordance with another embodiment of the invention. The reamer 91 has at least one circular dome shaped side cutter 92 adapted to rotate and expand radially outward relative to the tool housing 91 to a greater extent than the borehole diameter shown in left side. The radial extension of the side cones may be provided by drilling mud pressure or by use of other mechanical systems, including electrical powered systems.

It shall be appreciated that any combination of rotational side cones with non-circular and/or circular cross section which extends radially outward from the body of the reamer with an actuating mechanism can be utilized according to the present invention. Also the cone with non-circular cross sectional design illustrated in FIGS. 3, 4 and 8, are only examples of non-circular shapes, other non-circular designs will be readily understood by the person skilled in the art.

The invention claimed is:

1. A cutting tool integrated in a drillstring, the cutting tool comprising:

a reamer housing configured to rotate around an axis of rotation; and a side cutter arranged along a longitudinal axis of the drillstring in the reamer housing;

a first driving system configured to rotate the side cutter independently of the reamer housing; and a second driving system configured to rotate the reamer housing, wherein the side cutter is adapted to be rotated independently of the reamer housing by the first driving system around an axis that is not parallel to the axis of rotation of the reamer housing.

2. The cutting tool of claim 1, wherein the side cutter is rotatable from a passive position in which the side cutter does not protrude from the reamer housing to an active position in which the side cutter does protrude from the reamer housing.

3. The cutting tool of claim 1, wherein the side cutter has a noncircular cross section.

4. The cutting tool of claim 3, wherein the side cutter is disposed in an opening in the reamer housing, wherein the side cutter is shaped such that the side cutter does not protrude past a diameter defined by the reamer housing in a passive state of the side cutter, and in a rotating state of the side cutter ends thereof define a diameter which extends beyond the diameter defined by the reamer housing as the reamer housing rotates.

5. The cutting tool of claim 1, further comprising:

a drill bit; and wherein the first driving system rotates the side cutter independently of the reamer housing and the drill bit.

6. The cutting tool of claim 5, wherein the first driving system is one of a mud motor, a hydro motor, a hydraulic motor, and an electric motor.

7. The cutting tool of claim 6, further comprising a gear transmission system arranged to transfer rotational motion from the motor to the side cutter.

8. The cutting tool of claim 1, wherein the first driving system is one of a hydro motor, an electric motor, and a mechanical system which directly drives the side cutter.

9. A cutting tool integrated in a drillstring, the cutting tool comprising:

a reamer housing configured to rotate around an axis of rotation; and side cutters arranged along a longitudinal axis of the drillstring in the reamer housing;

driving systems configured to rotate the side cutters, respectively, independently of the reamer housing, wherein the side cutters are adapted to be rotated independently of the reamer housing by the driving systems, respectively, around an axis that is not parallel to the axis of rotation of the reamer housing.

10. The cutting tool of claim 9, wherein each of the driving systems is a mud motor.

11. The cutting tool of claim 9, wherein each of the driving systems is one of a mud motor, a hydro motor, a hydraulic motor, and an electric motor.

12. The cutting tool of claim 9, wherein the side cutters are rotatable from a passive position in which the side cutters do not protrude from the reamer housing to an active position in which the side cutters do protrude from the reamer housing.

13. The cutting tool of claim 9, wherein the side cutters extend radially outward from the reamer housing via an actuating mechanism.

14. The cutting tool of claim 13, wherein the actuating mechanism is one of mechanical means and drilling mud pressure.

15. The cutting tool of claim 9, wherein the side cutters are rotational side cones each of which has a non-circular cross section, and wherein the side cutters have different sizes to enlarge a borehole in a stepwise manner.

* * * * *